US009002019B2

(12) United States Patent
Ise

(10) Patent No.: US 9,002,019 B2
(45) Date of Patent: Apr. 7, 2015

(54) SOUND FIELD CONTROL APPARATUS AND METHOD FOR CONTROLLING SOUND FIELD

(75) Inventor: Tomohiko Ise, Fukushima (JP)

(73) Assignee: Alpine Electronics, Inc., Tokyo (JP)

( * ) Notice: Subject to any disclaimer, the term of this patent is extended or adjusted under 35 U.S.C. 154(b) by 927 days.

(21) Appl. No.: 13/080,310

(22) Filed: Apr. 5, 2011

(65) Prior Publication Data

US 2011/0249825 A1 Oct. 13, 2011

(30) Foreign Application Priority Data

Apr. 12, 2010 (JP) ..... 2010-091818

(51) Int. Cl.
*H04R 29/00* (2006.01)
*H04R 3/00* (2006.01)
*H04S 7/00* (2006.01)

(52) U.S. Cl.
CPC .. *H04R 3/005* (2013.01); *H04S 7/30* (2013.01)

(58) Field of Classification Search
CPC ..... H04R 2430/21; H04R 2430/23; H04R 3/005; H04R 2210/405; H04R 2201/401; H04R 1/406; H04R 1/326; H04R 27/00; H04R 2201/403; H04R 2430/20; H04R 2430/25; H04R 2430/30; H04R 29/005; H04R 2227/001; H04R 2227/009; H04R 3/00; H04R 3/04; H04R 3/06; H04R 19/04; H04R 1/04; H04R 1/222; H04R 2410/00; H04R 2410/05; H04R 29/006; H04S 7/301; H03F 2200/03; H03F 2200/372; H03G 5/165; H03G 3/3005; H03G 3/00
USPC ..... 381/92, 56, 58, 59, 66, 83, 93
See application file for complete search history.

(56) References Cited

U.S. PATENT DOCUMENTS 5,581,495 A * 12/1996 Adkins et al. ..... 381/92
6,600,824 B1 7/2003 Matsuo
6,760,449 B1 7/2004 Matsuo
7,316,162 B2 1/2008 Hald

FOREIGN PATENT DOCUMENTS

JP 3863306 12/2006

* cited by examiner

*Primary Examiner* — Ping Lee
(74) *Attorney, Agent, or Firm* — Brinks Gilson & Lione

(57) ABSTRACT

A sound field control apparatus includes at least two main microphones; for each main microphone, a set of at least two sub microphones arranged such that the at least two sub microphones are placed in different axis directions about each of the main microphones; a filtering unit; and a filter coefficient calculating unit configured to calculate a filter coefficient for the filtering unit. A filter coefficient used to control sound pressure levels and air particle velocities of an output audio signal is calculated on the basis of a sound pressure level detected by each main microphone and the difference between the sound pressure level detected by the main microphone and that detected by each of the corresponding sub microphones.

7 Claims, 6 Drawing Sheets

SOUND FIELD CONTROL APPARATUS AND METHOD FOR CONTROLLING SOUND FIELD

RELATED APPLICATIONS

The present application claims priority to Japanese Patent Application Ser. No. 2010-091818, filed Apr. 12, 2010, the entirety of which is hereby incorporated by reference.

BACKGROUND OF THE INVENTION

1. Field of the Invention

The present disclosure relates to an apparatus and method for sound field control, and in particular, the present disclosure relates to a technique suitable for use in a sound field control apparatus for adjusting or creating a space (sound field) where there is audio reproduced by an audio system.

2. Description of the Related Art

There have been provided many sound field control apparatuses for adjusting or creating a space (sound field) where there is audio reproduced by an audio system. Techniques for recreating a sound field just like in a real concert hall or movie theater through an audio system intended for home use have also been developed.

Most sound field control apparatuses proposed so far control a sound pressure level alone in a space. However, controlling a sound pressure level alone at a fixed point cannot control the velocity of particles as the flow of air upon propagation of a sound wave. It may produce a feeling of strangeness in the direction in which sound comes. Techniques for controlling an acoustic intensity corresponding to the product of a sound pressure level and a particle velocity or an acoustic impedance corresponding to the ratio of a sound pressure level to a particle velocity have also been proposed.

Controlling the acoustic intensity or acoustic impedance indirectly controls the sound pressure level and the particle velocity. The sound pressure level and the particle velocity are not necessarily controlled to desired states. For example, in a sound field control apparatus mounted on an in-vehicle audio system, it is desirable to create a sound field so that reproduced sound is equally audible by all persons sit in a vehicle interior. However, it is difficult to realize such a sound field by conventional methods for acoustic intensity control and acoustic impedance control.

Acoustic intensity control is intended to control acoustic intensities in directions excluding one direction so that the acoustic intensities approach to zero. Accordingly, an acoustic intensity in the one direction cannot be controlled to a desired value. If control conditions are not good, the direction of acoustic intensity flow may be opposite to a desired direction.

FIGS. 7A and 7B illustrate a sound pressure distribution and a particle velocity distribution when acoustic intensities were controlled in a predetermined space. The predetermined space is obtained by simulating a space in a vehicle interior. The $x_1$-axis direction (corresponding to the length direction of the vehicle interior) is set to 2 m, the $x_2$-axis direction (corresponding to the width direction thereof) is set to 1.3 m, and the $x_3$-axis direction (corresponding to the height direction thereof) is set to 0.8 m.

As for the acoustic intensity control, for example, the acoustic intensity in the $x_2$-axis direction (the width direction of the vehicle interior) is controlled at zero, so that sound pressure levels in the $x_2$-axis direction can be substantially equalized, as illustrated in the sound pressure distribution of FIG. 7A. However, sound pressure levels in the $x_1$-axis direction (the length direction of the vehicle interior) cannot be equalized. Referring to FIG. 7A, sound pressure levels are too high in positions corresponding to the windshield of a vehicle and a headrest of a rear seat. On the other hand, sound pressure levels are too low in positions corresponding to a headrest of a front seat. Furthermore, air particles flowed from a rear portion of the vehicle interior to a front portion thereof, as illustrated in FIG. 7B.

Acoustic impedance control is intended to control an acoustic impedance in one direction so that the acoustic impedance is equalized to the characteristic impedance of air in order to cancel out reflected sound in the one direction. In this case, acoustic impedances in other directions cannot be controlled to desired values. If control conditions are not good, the direction of acoustic impedance flow may be opposite to a desired direction.

FIGS. 8A and 8B illustrate a sound pressure distribution and a particle velocity distribution when acoustic impedances were controlled in the same space as that in FIGS. 7A and 7B. As for the acoustic impedance control, for example, the acoustic impedance in the $x_2$-axis direction (the width direction of the vehicle interior) is controlled so that the acoustic impedance is equalized to the characteristic impedance of air, so that sound pressure levels in the $x_2$-axis direction can be substantially equalized, as illustrated in the sound pressure distribution of FIG. 8A. However, sound pressure levels in the $x_1$-axis direction (the length direction of the vehicle interior) cannot be equalized. Accordingly, sound pressure levels are too high in positions corresponding to the windshield of the vehicle and the headrest of the rear seat and sound pressure levels are too low in positions corresponding to the headrest of the front seat in a manner similar to that illustrated in FIG. 7A. Furthermore, the flow of air particles from the front portion of the vehicle interior to the rear portion and that from the rear portion to the front portion were mixed, as illustrated in FIG. 8B.

There has been proposed a technique of obtaining the relationship between a temporal change in sound pressure level and that in air particle velocity and the relationship between a spatial change in sound pressure level and that in air particle velocity, obtaining a sound pressure level at a specified position in a space on the basis of the obtained relationships, and outputting the obtained sound pressure level (refer to Japanese Patent No. 3863306, for example).

According to the conventionally proposed control techniques, a sound pressure level and an air particle velocity are indirectly controlled. Disadvantageously, control performance is not sufficiently delivered when these techniques are applied to, for example, an in-vehicle audio system.

According to the technique disclosed in Japanese Patent No. 3863306, a sound pressure level alone at a specified position is obtained on the basis of the relationships between changes in sound pressure level and those in air particle velocity. The technique is not intended to correct sound pressure levels and air particle velocities in an acoustic space to desired characteristics. New techniques are desirable to correct sound pressure levels and air particle velocities in the acoustic space to desired characteristics.

SUMMARY OF THE INVENTION

The present disclosure is directed to systems and methods that address the above-described disadvantages. It is one object of the present invention to control sound pressure levels and air particle velocities in a space to desired states so that a desired sound field is created.

In one aspect of the present disclosure, a sound field control apparatus includes K (K≥2) main microphones arranged at points of measurement in a space; K sets of sub microphones arranged such that X (X≥2) sub microphones are placed in different axis directions about each of the K main microphones; a filtering unit configured to filter an input audio signal; at least one speaker configured to output the filtered audio signal; and a filter coefficient calculating unit configured to calculate a filter coefficient for the filtering unit. The filter coefficient calculating unit is configured to calculate the filter coefficient used to control sound pressure levels and air particle velocities of the output audio signal on the basis of a sound pressure level detected by each main microphone and the difference between the sound pressure level detected by the main microphone and that detected by each of the corresponding sub microphones.

The sound pressure levels and air particle velocities of the output audio signal are independently and directly controlled by the filtering unit in accordance with the filter coefficient calculated by the filter coefficient calculating unit. Furthermore, air particle velocities in at least two axis directions are controlled on the basis of the difference between a sound pressure level detected by each main microphone and that of each of the corresponding X (X≥2) sub microphones. The differences in sound pressure level are measured in at least K (K≥2) points set so as to provide a spatial dimension in a target space where a sound field is to be created.

Accordingly, if there are K main microphones and K×X sub microphones ({(K+1)×X} microphones in total, namely, at least six microphones), the sound pressure levels and air particle velocities in at least two axis directions of an output audio signal can be independently and directly controlled in a space having a predetermined dimension defined by K points of measurement. Thus, the sound pressure levels and air particle velocities in the space can be controlled to desired states, thus creating a desired sound field.

DESCRIPTION OF THE PREFERRED EMBODIMENTS

Figure 1:
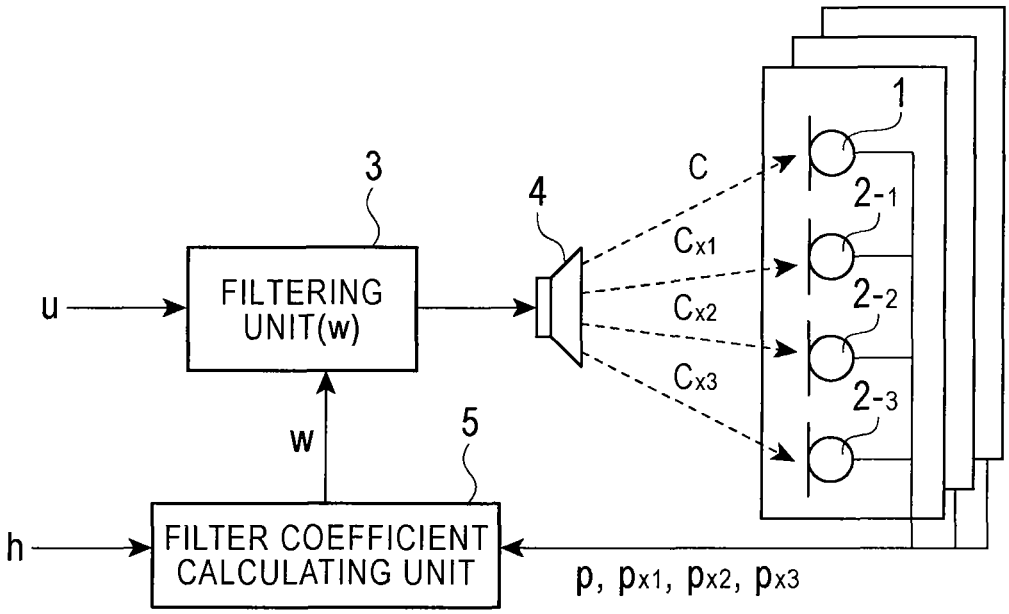
FIG. 1 is a diagram illustrating an exemplary configuration of a sound field control apparatus.

FIG. 1 illustrates an exemplary configuration of a sound field control apparatus. Referring to FIG. 1, the sound field control apparatus includes K (K≥2) main microphones 1 arranged at points of measurement in a space; K sets of sub microphones $\mathbf{2}_{-1}$, $\mathbf{2}_{-2}$, $\mathbf{2}_{-3}$ arranged such that X (X≥2) sub microphones are placed in different axis directions about each of the K main microphones; a filtering unit 3 that filters an input audio signal u; at least one speaker 4 that outputs the filtered audio signal; and a filter coefficient calculating unit 5 that calculates a filter coefficient for the filtering unit 3.

The filter coefficient calculating unit 5 is configured to calculate a filter coefficient w used to control sound pressure levels and air particle velocities of an audio signal output from the speaker 4 in the space on the basis of a sound pressure level p detected by each main microphone 1 and the difference between the sound pressure level ρ detected by the main microphone 1 and each of sound pressure levels $\rho_{x1}$, $\rho_{x2}$, and $\rho_{x3}$ detected by the corresponding sub microphones $\mathbf{2}_{-1}$, $\mathbf{2}_{-2}$, $\mathbf{2}_{-3}$. The filter coefficient calculating unit 5 is additionally configured to set the obtained filter coefficient w in the filtering unit 3.

In some implementations, the quotients of the above-described differences ($\rho-\rho_{x1}$, $\rho-\rho_{x2}$, and $\rho-\rho_{x3}$) in sound pressure level divided by the distances ($\Delta x_1$, $\Delta x_2$, and $\Delta x_3$) between each main microphone 1 and the corresponding sub microphones $\mathbf{2}_{-1}$, $\mathbf{2}_{-2}$, $\mathbf{2}_{-3}$ are defined as "sound pressure gradients". The sound pressure gradients are converted into air particle velocities. The reason is that it is practically difficult to directly measure air particle velocities. Therefore, sound pressure levels and sound pressure gradients in a paired relationship with air particle velocities are controlled to desired characteristics.

Specifically, the filter coefficient calculating unit 5 is configured to obtain an acoustic system transfer function of sound pressure level ρ on the basis of sound pressure levels ρ detected by the main microphones 1. The filter coefficient calculating unit 5 converts sound pressure gradients obtained on the basis of the sound pressure levels detected by the main microphones 1 and the sub microphones $\mathbf{2}_{-1}$, $\mathbf{2}_{-2}$, $\mathbf{2}_{-3}$ into air particle velocities to obtain acoustic system transfer functions of air particle velocity. Then, the filter coefficient calculating unit 5 calculates a filter coefficient w (corresponding to a transfer function for the filtering unit 3) to be set in the filtering unit 3 on the basis of the acoustic system transfer function of sound pressure level and the acoustic system transfer functions of air particle velocity.

Figure 2:
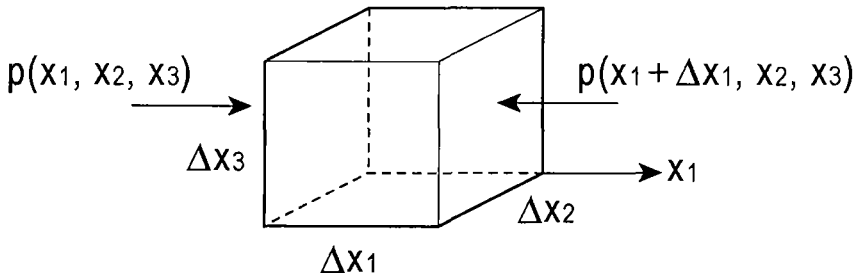
FIG. 2 is a diagram illustrating sound pressures applied to an infinitesimal volume element of air.

First, the relationship between a sound pressure gradient and an air particle velocity is derived. In this case, attention is paid to an infinitesimal volume element $\Delta x_1 \Delta x_2 \Delta x_3$ as an air cube in a space defined by three axes, i.e., the $x_1$ axis, the $x_2$ axis, and the $x_3$ axis which are orthogonal to one another as illustrated in FIG. 2. Pressure applied to gaseous matter is a scalar quantity acting in all directions. As for the $x_1$-axis direction, for instance, a force of $\rho(x_1, x_2, x_3, t)$ is applied from the left and a force of $-\rho(x_1+\Delta x_1, x_2, x_3, t)$ is applied from the right at certain time t. Accordingly, the sum F of the forces acting in the $x_1$-axis direction of this cube is expressed by the following equation.

$$F = \{p(x_1, x_2, x_3, t) - p(x_1 + \Delta x_1, x_2, x_3, t)\}\Delta x_2 \Delta x_3 = \Delta x_1 \Delta x_2 \Delta x_3 \frac{\partial p(x_1, x_2, x_3, t)}{\partial x_1} \quad (1)$$

When Equation (1) and the following Equations (2) and (3) are substituted into Newton's equation of motion (F=ma), the relationship expressed by Equation (4) is obtained. In this case, m denotes the mass of air, $\rho_0$ denotes the density of air, a denotes acceleration, and $v_{x1}$ denotes an air particle velocity in the $x_1$-axis direction.

$$m = \rho_0 \Delta x_1 \Delta x_2 \Delta x_3 \tag{2}$$

$$a = \frac{\partial v_{x1}(x_1, x_2, x_3, t)}{\partial t} \tag{3}$$

$$\rho_0 \frac{\partial v_{x1}(x_1, x_2, x_3, t)}{\partial t} = \frac{\partial p(x_1, x_2, x_3, t)}{\partial x_1} \tag{4}$$

As for the $x_2$-axis direction and the $x_3$-axis direction, the relationships expressed by Equations (5) and (6) are similarly obtained. The three-dimensional directions expressed by Equations (4) to (6) can be combined and can also be expressed by Equation (7).

$$\rho_0 \frac{\partial v_{x2}(x_1, x_2, x_3, t)}{\partial t} = \frac{\partial p(x_1, x_2, x_3, t)}{\partial x_2} \tag{5}$$

$$\rho_0 \frac{\partial v_{x3}(x_1, x_2, x_3, t)}{\partial t} = \frac{\partial p(x_1, x_2, x_3, t)}{\partial x_3} \tag{6}$$

$$\rho_0 \frac{\partial x(x, t)}{\partial t} = \nabla p(xt) \tag{7}$$

Equations (8) and (9) are derived from the relationship with the Fourier transform pair of an air particle velocity v(x, t). Equation (8) is Fourier transform and Equation (9) is inverse Fourier transform. Equation (10) is given by differentiating Equation (8) with respect to time. Equation (10) is subjected to Fourier transform, thus obtaining the relationship expressed by Equation (11).

$$v(x, t) = \frac{1}{2\pi} \int_{-\infty}^{\infty} v(x, \omega) \exp(j\omega t) d\omega \tag{8}$$

$$v(x, \omega) = \int_{-\infty}^{\infty} v(x, t) \exp(-j\omega t) dt \tag{9}$$

$$\frac{\partial v(x, t)}{\partial t} = \frac{1}{2\pi} \int_{-\infty}^{\infty} j\omega v(x, \omega) \exp(j\omega t) d\omega \tag{10}$$

$$F\left(\frac{\partial v(x, t)}{\partial t}\right) = j\omega v(x, \omega) \tag{11}$$

Therefore, Equation (7) is subjected to Fourier transform and the resultant equation is substituted into Equation (11), thus obtaining Equation (12). On the other hand, the relationships expressed by Equations (13) to (15) hold.

$$v(x, \omega) = \frac{1}{j\omega\rho_0} \nabla p(x, \omega) \tag{12}$$

$$\frac{\partial p(x_1, x_2, x_3, \omega)}{\partial x_1} = \frac{p(x_1, x_2, x_3, \omega) - p(x_1 + \Delta x_1, x_2, x_3, \omega)}{\Delta x_1} \tag{13}$$

$$\frac{\partial p(x_1, x_2, x_3, \omega)}{\partial x_2} = \frac{p(x_1, x_2, x_3, \omega) - p(x_1, x_2 + \Delta x_2, x_3, \omega)}{\Delta x_2} \tag{14}$$

$$\frac{\partial p(x_1, x_2, x_3, \omega)}{\partial x_3} = \frac{p(x_1, x_2, x_3, \omega) - p(x_1, x_2, x_3 + \Delta x_3, \omega)}{\Delta x_3} \tag{15}$$

Equations (13) to (15) are substituted into Equation (12), thus obtaining the relationships between sound pressure gradients and air particle velocities expressed by Equations (16) to (18). In each of Equations (16) to (18), the left side corresponds to the air particle velocity and the right side corresponds to the sound pressure gradient.

$$v_{x1}(x, \omega) = \frac{1}{j\omega\rho_0} \frac{p(x_1, x_2, x_3, \omega) - p(x_1 + \Delta x_1, x_2, x_3, \omega)}{\Delta x_1} \tag{16}$$

$$v_{x2}(x, \omega) = \frac{1}{j\omega\rho_0} \frac{p(x_1, x_2, x_3, \omega) - p(x_1, x_2 + \Delta x_2, x_3, \omega)}{\Delta x_2} \tag{17}$$

$$v_{x3}(x, \omega) = \frac{1}{j\omega\rho_0} \frac{p(x_1, x_2, x_3, \omega) - p(x_1, x_2, x_3 + \Delta x_3, \omega)}{\Delta x_3} \tag{18}$$

Figure 3:
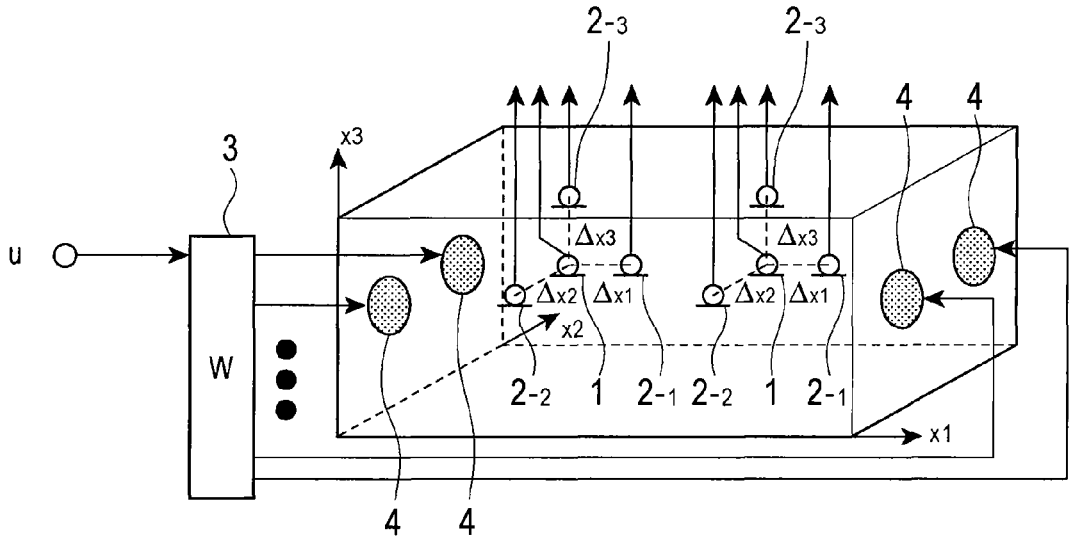
FIG. 3 is a diagram illustrating an acoustic system to which the sound field control apparatus may be applied.

Subsequently, an acoustic system as illustrated in FIG. 3 is assumed. In the acoustic system illustrated in FIG. 3, K (in this case, two) main microphones 1 and X sub microphones $\mathbf{2}_{-1}$, $\mathbf{2}_{-2}$, $\mathbf{2}_{-3}$ (in this case, three sub microphones in the three axis directions of the $x_1$, $x_2$, and $x_3$ axes about each of the main microphones 1) are arranged such that these sets of microphones arranged in the three axis directions are paired. In addition, M (M≥1) speakers (in this case, four speakers) 4 are arranged as sound sources.

Let $C_{1-1}$, $C_{1x1-1}$, $C_{1x2-1}$, $C_{1x3-1}$, $C_{K-M}$, $C_{Kx1-M}$, $C_{Kx2-M}$, and $C_{Kx3-m}$ denote the acoustic system transfer functions of sound pressure level until audio signals output from the M speakers 4 are input to the K main microphones 1 and the K sets of the sub microphones $\mathbf{2}_{-1}$, $\mathbf{2}_{-2}$, $\mathbf{2}_{-3}$. The filtering unit 3 having filter coefficients $w_1, \ldots,$ and $w_M$ is placed at a stage before the speakers 4. An audio signal u is input to the filtering unit 3. Accordingly, sound pressure levels ρ, $\rho_{x1}$, $\rho_{x2}$, and $\rho_{x3}$ at the main microphones 1 and the sub microphones $\mathbf{2}_{-1}$, $\mathbf{2}_{-2}$, $\mathbf{2}_{-3}$ are expressed as Equations (19) to (22).

$$\rho(\omega) = C(\omega) w(\omega) u(\omega) \tag{19}$$

$$\rho_{x1}(\omega) = C_{x1}(\omega) w(\omega) u(\omega) \tag{20}$$

$$\rho_{x2}(\omega) = C_{x2}(\omega) w(\omega) u(\omega) \tag{21}$$

$$\rho_{x3}(\omega) = C_{x3}(\omega) w(\omega) u(\omega) \tag{22}$$

Elements in Equation (19) are expressed as Equations (23) to (25). Accordingly, the relationships of Equations (26) to (28) are obtained from the relationships between sound pressure gradients and air particle velocities expressed by Equations (16) to (18). In the following equations, $B_{x1}$, $B_{x2}$, and $B_{x3}$ denote acoustic system transfer functions of air particle velocity related to the three axis directions, i.e., the $x_1$, $x_2$, and $x_3$ axes.

$$p(\omega) = [p_1(\omega) p_2(\omega) \cdots p_k(\omega)]^T \tag{23}$$

$$C(\omega) = \begin{bmatrix} C_{1-1} & C_{1-2} & \cdots & C_{1-M} \\ C_{2-1} & C_{2-2} & \cdots & C_{2-M} \\ \vdots & \vdots & \ddots & \vdots \\ C_{K-1} & C_{K-2} & \cdots & C_{K-M} \end{bmatrix} \tag{24}$$

$$w(\omega) = [w_1(\omega) w_2(\omega) \cdots w_M(\omega)]^T \tag{25}$$

$$v_{x1}(\omega) = \frac{1}{j\omega\rho_0 \Delta x_1} \{C(\omega) - C_{x1}(\omega)\} w(\omega) u(\omega) = B_{x1}(\omega) w(\omega) u(\omega) \tag{26}$$

$$v_{x2}(\omega) = \frac{1}{j\omega\rho_0 \Delta x_2} \{C(\omega) - C_{x2}(\omega)\} w(\omega) u(\omega) = B_{x2}(\omega) w(\omega) u(\omega) \tag{27}$$

$$v_{x3}(\omega) = \frac{1}{j\omega\rho_0 \Delta x_3} \{C(\omega) - C_{x3}(\omega)\} w(\omega) u(\omega) = B_{x3}(\omega) w(\omega) u(\omega) \tag{28}$$

On the other hand, $h_1$, $h_{1vx1}$, $n_{1vx2}$, $n_{1vx3}$, . . . , $h_K$, $h_{Kvx1}$, $h_{Kvx2}$, and $h_{Kvx3}$ denote target transfer functions of air particle velocity until audio signals are input to the K main microphones 1 and the K sets of the sub microphones $\mathbf{2}_{-1}$, $\mathbf{2}_{-2}$, $\mathbf{2}_{-3}$. A characteristic for creating a desired sound field is set as a target transfer function h in the filter coefficient calculating unit 5. In this case, the relationship between input and output of an audio signal in the desired sound field is expressed by Equation (29).

$$h(\omega)=[C(\omega)B_{x1}(\omega)B_{x2}(\omega)B_{x3}(\omega)]^{T}w(\omega) \tag{29}$$

When the acoustic system transfer function C of sound pressure level and the acoustic system transfer functions $B_{x1}$, $B_{x2}$, and $B_{x3}$ of air particle velocity in Equation (29) are multiplied by weighting factors $\alpha_p$, $\alpha_{vx1}$, $\alpha_{vx2}$, and $\alpha_{vx3}$, Equation (30) is obtained. Thus, control can be concentrated on an element to which attention is to be paid.

$$h(\omega)=[\alpha_p C(\omega)\alpha_{vx1}B_{x1}(\omega)\alpha_{vx2}B_{x2}(\omega)\alpha_{vx3}B_{x3}(\omega)]^{T}W(\omega) \tag{30}$$

Therefore, the optimum solution of the filter coefficient w to be set in the filtering unit 3 is expressed as Equation (31) so that the root mean square error is minimized. In the matrix on the right side, the superscript "+" denotes a pseudo inverse matrix.

$$w(\omega)=[\alpha_p C(\omega)\alpha_{vx1}B_{x1}(\omega)\alpha_{vx2}B_{x2}(\omega)\alpha_{vx3}B_{x3}(\omega)]^{T+}h(\omega) \tag{31}$$

The filter coefficient calculating unit 5 is configured to calculate the filter coefficient w in the filtering unit 3 using Equation (31). Specifically, the filter coefficient calculating unit 5 obtains the acoustic system transfer function C of sound pressure level p on the basis of the sound pressure levels p detected by the main microphones 1. In addition, the filter coefficient calculating unit 5 converts sound pressure gradients obtained on the basis of the sound pressure levels ρ, $\rho_{x1}$, $\rho_{x2}$, and $\rho_{x3}$ detected by the main microphones 1 and the sub microphones $\mathbf{2}_{-1}$, $\mathbf{2}_{-2}$, and $\mathbf{2}_{-3}$ into air particle velocities to obtain acoustic system transfer functions $B_{x1}$, $B_{x2}$, and $B_{x3}$ of air particle velocity. The filter coefficient calculating unit 5 then calculates the filter coefficient w for the filtering unit 3 using Equation (31) on the basis of the acoustic system transfer function C of sound pressure level, the acoustic system transfer functions $B_{x1}$, $B_{x2}$, and $B_{x3}$ of air particle velocity, and the target transfer function h of air particle velocity.

As described above, the acoustic system transfer function C of sound pressure level and the acoustic system transfer functions $B_{x1}$, $B_{x2}$, and $B_{x3}$ of air particle velocity in Equation (29) are multiplied by the weighting factors $\alpha_p$, $\alpha_{vx1}$, $\alpha_{vx2}$, and $\alpha_{vx3}$, thus obtaining Equation (30). However, the weighting factors are not necessarily used. Specifically, the filter coefficient calculating unit 5 may calculate the filter coefficient w using Equation (32) which is a modification of Equation (29).

$$w(\omega)=[C(\omega)B_{x1}(\omega)B_{x2}(\omega)B_{x3}(\omega)]^{T+}h(\omega) \tag{32}$$

A process of calculating the pseudo inverse matrix expressed by Equation (31) or (32) is useful when the calculation can be performed in advance using, for example, a personal computer. When the calculation is performed by a digital signal processor (DSP) chip built in an audio product, however, the process is heavy. Hence, sequential computation with an adaptive filter based on a least mean square (LMS) algorithm, which will be derived as follows, may be performed.

Figure 4:
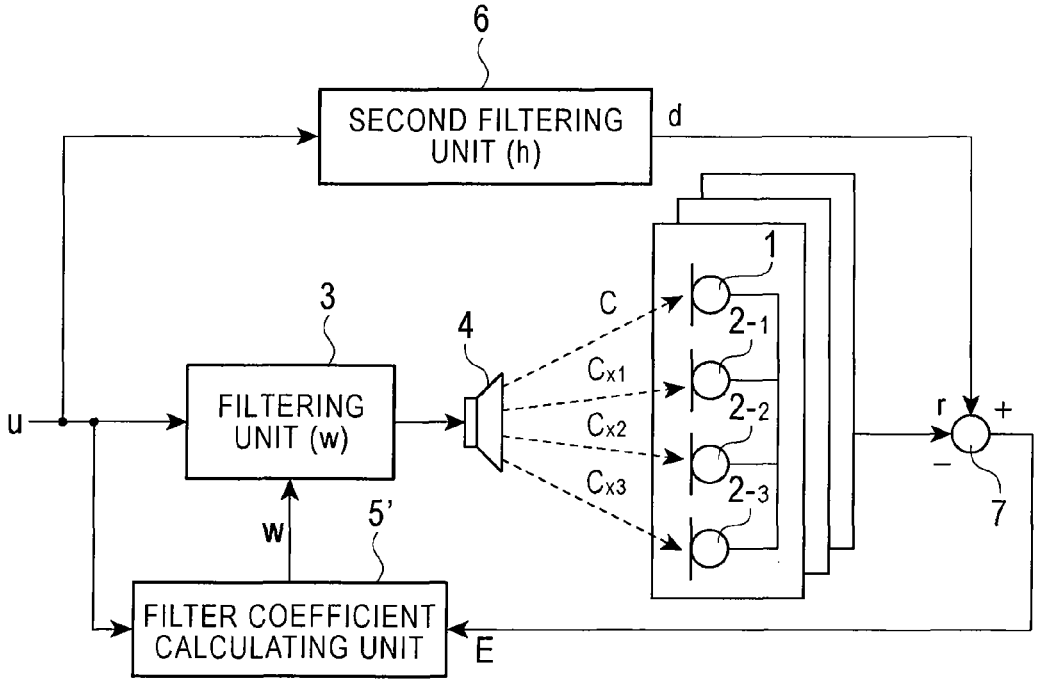
FIG. 4 is a diagram illustrating another exemplary configuration of a sound field control apparatus.

FIG. 4 illustrates another exemplary configuration of a sound field control apparatus. In FIG. 4, components designated by the same reference numerals as those in FIG. 1 have the same functions as those in FIG. 1 and redundant description is avoided.

Referring to FIG. 4, the sound field control apparatus includes, as a component for calculating a filter coefficient w for the filtering unit 3, a filter coefficient calculating unit 5' instead of the filter coefficient calculating unit 5 in FIG. 1. The sound field apparatus further includes a second filtering unit 6 that filters an input audio signal u in accordance with a filter coefficient based on the target transfer function h of air particle velocity and an error calculating unit 7 that calculates an error E between a target response d, calculated by the second filtering unit 6, and a real response r of an audio signal output from a speaker 4 and input to the main microphones 1 and the sub microphones $\mathbf{2}_{-1}$, $\mathbf{2}_{-2}$, and $\mathbf{2}_{-3}$. The filtering unit 3, the filter coefficient calculating unit 5', the second filtering unit 6, and the error calculating unit 7 can be built in the DSP chip.

The filter coefficient calculating unit 5' includes an adaptive filter based on the LMS algorithm. The filter coefficient calculating unit 5' operates based on the input audio signal u and the error E calculated by the error calculating unit 7 so that the power of the error E is minimized, thus calculating a filter coefficient w for the filtering unit 3. Calculation by the filter coefficient calculating unit 5' will be described below.

When the error E between the real response r and the target response d is expressed by Equation (33) on the basis of Equations (30) and (31), the power $E^{H}E$, where the superscript "H" denotes the Hermitian transpose of a matrix, of the error E is given by Equation (34).

$$E(\omega) = d(\omega) - [\alpha_p C(\omega)\ \alpha_{vx1}B_{x1}(\omega)\ \alpha_{vx2}B_{x2}(\omega)\ \alpha_{vx3}B_{x3}(\omega)]^{T}w(\omega)u(\omega) \tag{33}$$

$$\begin{aligned} E^{H}(\omega)E(\omega) = {} & d^{H}(\omega)d(\omega) - d^{H}(\omega)[\alpha_p C(\omega)\ \alpha_{vx1}B_{x1}(\omega)\ \alpha_{vx2}B_{x2}(\omega)\ \alpha_{vx3}B_{x3}(\omega)]^{T} w(\omega)u(\omega) - u^{*}(\omega) \\ & w^{H}(\omega)[\alpha_p C(\omega)\ \alpha_{vx1}B_{x1}(\omega)\ \alpha_{vx2}B_{x2}(\omega)\ \alpha_{vx3}B_{x3}(\omega)]^{T^{H}} d(\omega) + \\ & u^{*}(\omega)w^{H}(\omega)[\alpha_p C(\omega)\ \alpha_{vx1}B_{x1}(\omega)\ \alpha_{vx2}B_{x2}(\omega)\ \alpha_{vx3}B_{x3}(\omega)]^{T^{H}} \cdot \\ & [\alpha_p C(\omega)\ \alpha_{vx1}B_{x1}(\omega)\ \alpha_{vx2}B_{x2}(\omega)\ \alpha_{vx3}B_{x3}(\omega)]^{T} w(\omega)u(\omega) \end{aligned} \tag{34}$$

As will be understood from Equation (34), the power of the error E results from the filter coefficient w in the filtering unit 3. When the power of the error E is minimized, the instantaneous gradient of the power of the error E to the filter coefficient w is at zero. Since the instantaneous gradient is given by Equation (35), the sequential computation algorithm of the adaptive filter based on the LMS is expressed by Equation (36), where μ denotes a step size parameter, n denotes the number of sequential computation updates by the adaptive filter, and u* denotes the conjugate complex number of the input audio signal u.

$$\frac{\partial E^{H}(\omega)E(\omega)}{\partial w(\omega)} = -2u^{*}(\omega)[\alpha_p C(\omega)\ \alpha_{vx1}B_{x1}(\omega)\ \alpha_{vx2}B_{x2}(\omega)\ \alpha_{vx3}B_{x3}(\omega)]^{T^{H}} E(\omega) \tag{35}$$

$$w(n+1, \omega) = w(n, \omega) + 2\mu u^{*}(\omega)[\alpha_p C(\omega)\ \alpha_{vx1}B_{x1}(\omega)\ \alpha_{vx2}B_{x2}(\omega)\ \alpha_{vx3}B_{x3}(\omega)]^{T^{H}} E(\omega) \tag{36}$$

Although the case using the weighting factors $\alpha_p$, $\alpha_{vx1}$, $\alpha_{vx2}$, and $\alpha_{vx3}$ has been described, the weighting factors are not necessarily used. In other words, the filter coefficient calculating unit 5' may calculate a filter coefficient using Equation (37).

$$w(n+1, \omega)=w(n, \omega)+2\mu u^*(\omega)[C(\omega)B_{x1}(\omega)B_{x2}(\omega)B_{x3}(\omega)]^{T^H}E(\omega) \quad (37)$$

Figure 5:
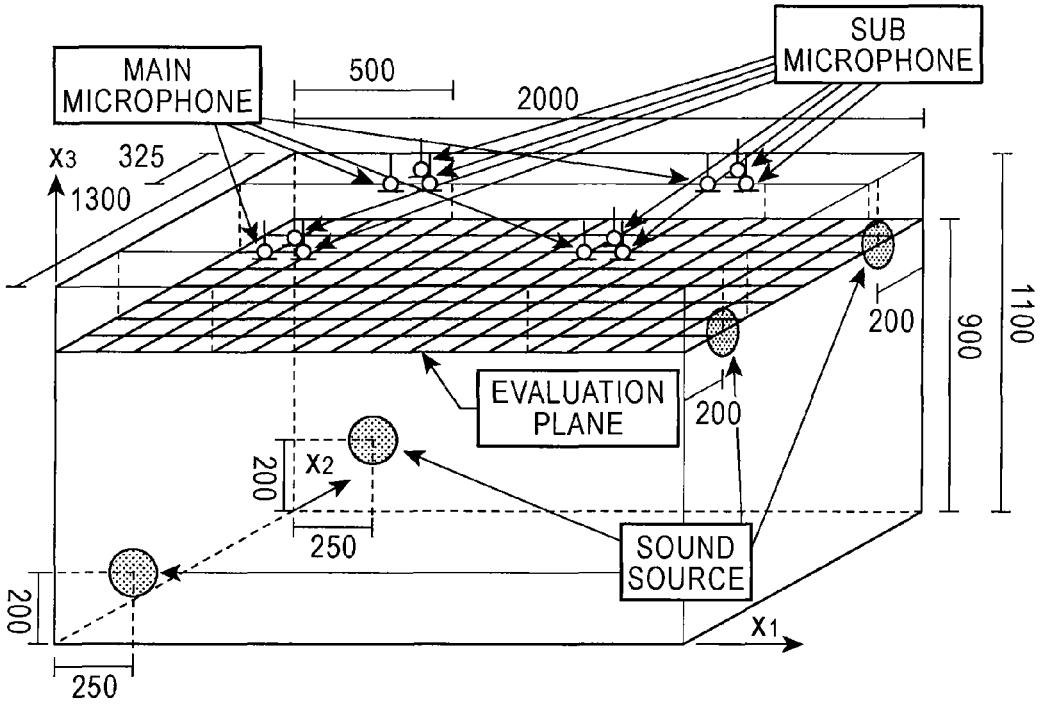
FIG. 5 is a diagram illustrating a sound field to which the sound field control apparatus may be applied.

Advantages obtained by the sound field control apparatus will be described below. FIG. 5 illustrates a rectangular parallelepiped sound field having dimensions of 2000 mm×1300 mm×1100 mm, the dimensions being close to those of the interior of a sedan of 2000 cc class. Four speakers 4 are placed in positions corresponding to lower portions of front doors of a vehicle and upper portions of rear doors thereof. The main microphones 1 are arranged in four positions on the ceiling and the sub microphones $\mathbf{2}_{-1}$ and $\mathbf{2}_{-2}$ are arranged in the $x_1$-axis and $x_2$-axis directions of each main microphone 1. The distance $\Delta x_1$ between each main microphone 1 and the corresponding sub microphone $\mathbf{2}_{-1}$ and the distance $\Delta x_2$ between the main microphone 1 and the corresponding sub microphone $\mathbf{2}_{-2}$ are each 162.5 mm.

Target transfer functions $h_1$, $h_{1vx1}$, $h_{1vx2}$, . . . , $h_4$, $h_{4vx1}$, and $N_{4vx2}$ of air particle velocity were set so as to have such characteristics that a plane wave propagates from the left to the right (from a front portion of the vehicle to a rear portion) in the $x_1$-axis direction in a free sound field. To evaluate whether plane wave propagation can be made, points of evaluation of sound pressure distribution and air particle velocity were set on a two-dimensional plane assumed at the same height as the level of ears of a seated adult. As for the intervals between evaluation points, 17 points were set at intervals of 125 mm in the $x_1$-axis direction and 9 points were set at intervals of 162.5 mm in the $x_2$-axis direction. Accordingly, data items of 153 points in all were used.

Figure 6A:
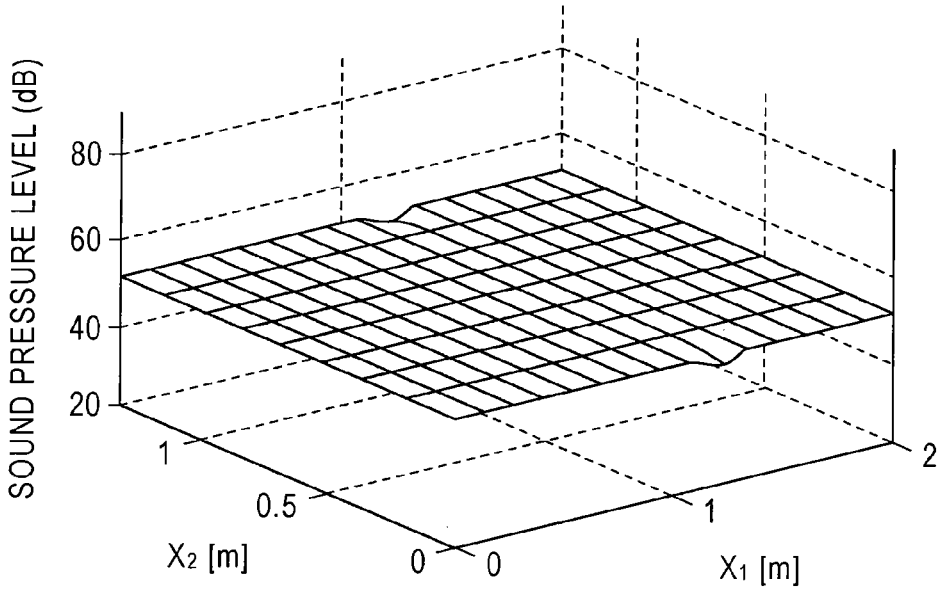
FIGS. 6A and 6B are diagrams illustrating a sound pressure distribution and air particle velocity distribution in the sound field to which the sound field control apparatus may be applied.
Figure 6B:
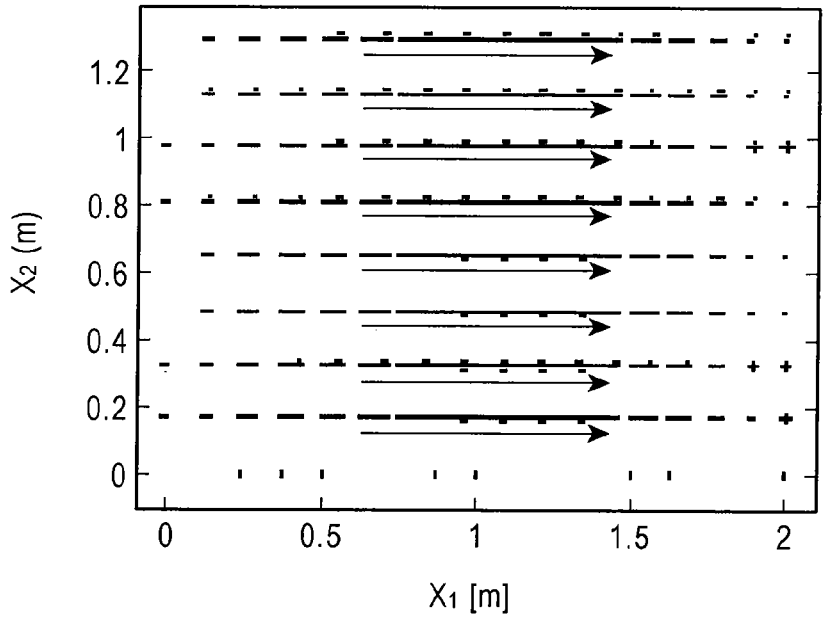
Figure 7A:
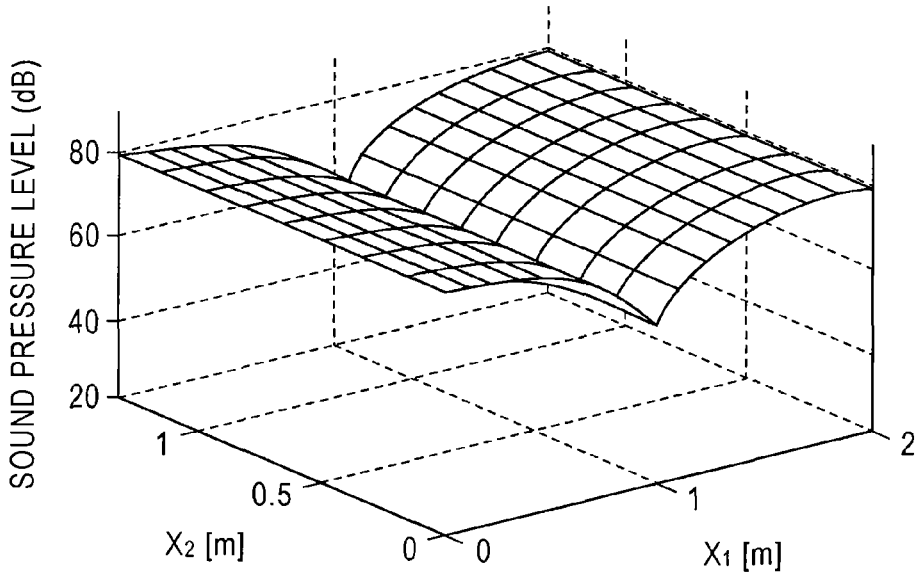
FIGS. 7A and 7B are diagrams illustrating a sound pressure distribution and air particle velocity distribution in a sound field using conventional intensity control.
Figure 7B:
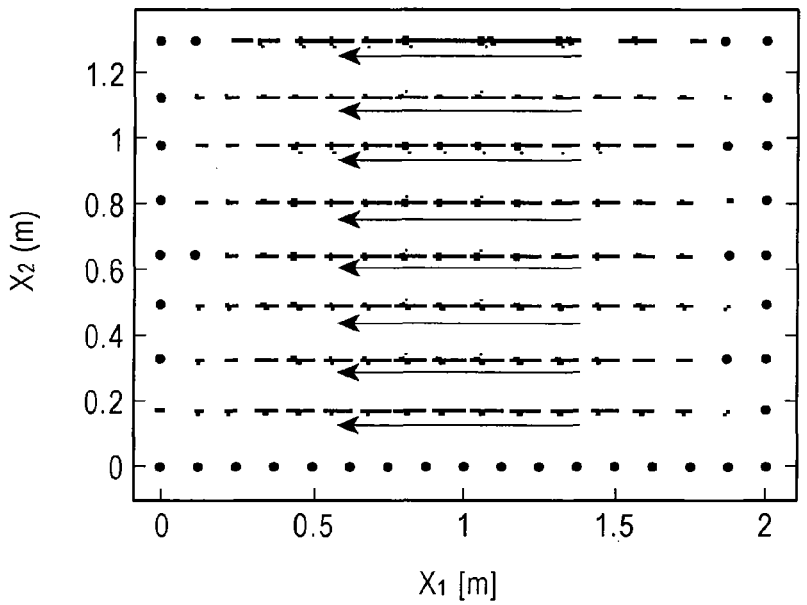
Figure 8A:
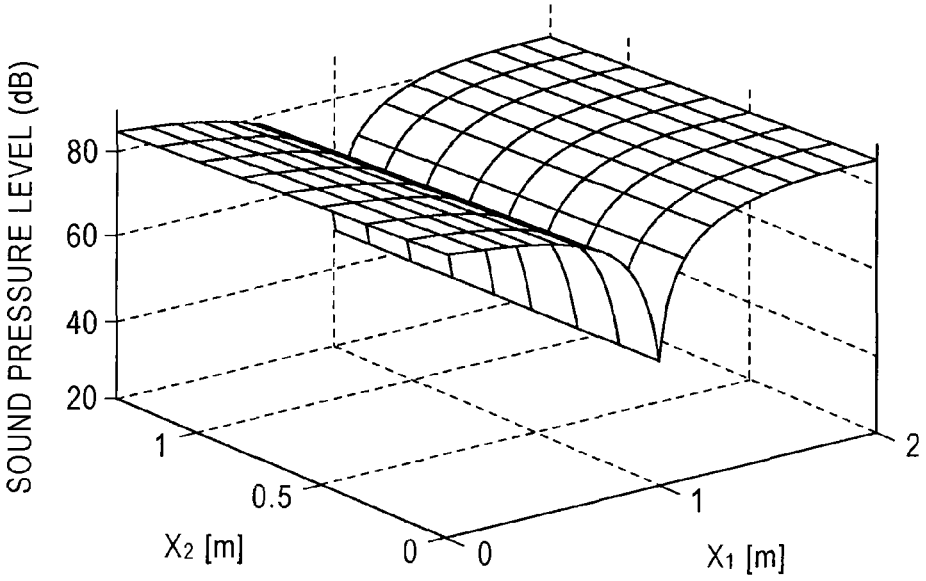
FIGS. 8A and 8B are diagrams illustrating a sound pressure distribution and air particle velocity distribution in a sound field using conventional impedance control.
Figure 8B:
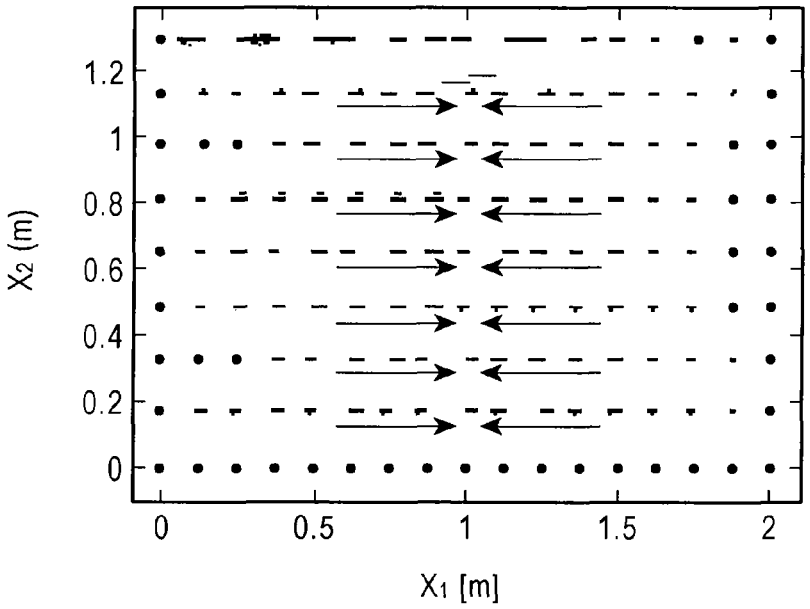

FIGS. 6A and 6B are diagrams illustrating evaluations. As is clear from FIG. 6A, the sound pressure distribution has no peak dip and is substantially flattened in the present embodiment. As illustrated in FIG. 6B, air particle velocities are constant from the left to the right. As described in the implementations above, plane wave propagation from the left to the right in the $x_1$-axis direction can be achieved in a desired free sound field.

Further, as described in the implemetnations above, the sound pressure levels and air particle velocities of an output audio signal are independently and directly controlled by the filtering unit 3 in accordance with a filter coefficient w calculated by the filter coefficient calculating unit 5 (or the filter coefficient calculating unit 5'). Furthermore, air particle velocities in at least two axis directions are controlled on the basis of the difference between a sound pressure level detected by each main microphone 1 and that of each of the corresponding X(X≥2) sub microphones $\mathbf{2}_{-1}$, $\mathbf{2}_{-2}$, and $\mathbf{2}_{-3}$. The differences in sound pressure level are measured in at least K (K≥2) points set so as to provide a spatial dimension in a target space where a sound field is to be created.

Accordingly, if there are K main microphones 1 and K×X sub microphones $\mathbf{2}_{-1}$, $\mathbf{2}_{-2}$, and $\mathbf{2}_{-3}$ ({(K+1)×X} microphones in total, namely, at least six microphones), the sound pressure levels and air particle velocities in at least two axis directions of an output audio signal can be independently and directly controlled in a space (a linear space when K=2 or a plane space when K≥3) having a predetermined dimension defined by K points of measurement. Thus, the sound pressure levels and air particle velocities in the space can be controlled to desired states, thus creating a desired sound field.

The embodiments described above are examples of implementations of the present invention and are not intended to limit the interpretation of the technical scope of the present invention. Various changes and modifications of the present invention are therefore possible without departing from the spirit or essential features of the invention. It is therefore intended that the foregoing detailed description be regarded as illustrative rather than limiting, and that it be understood that it is the following claims, including all equivalents, that are intended to define the spirit and scope of this invention.

What is claimed is:

1. A sound field control apparatus comprising:

at least two main microphones arranged at points of measurement in a space;

for each main microphone of the at least two main microphones, at least two sub microphones associated with the main microphone arranged such that the at least two sub microphones are placed in different axis directions about the main microphone that the at least two sub microphones are associated with, where each of the sub microphones is not a main microphone;

a filtering unit configured to filter an input audio signal;

at least one speaker configured to output the audio signal filtered by the filtering unit; and a filter coefficient calculating unit in communication with the filtering unit, the filter coefficient calculating unit configured to calculate a filter coefficient, used to control sound pressure levels and air particle velocities of the audio signal output from the speaker in the space, for the filtering unit on the basis of a sound pressure level detected by each main microphone and the difference between the sound pressure level detected by the main microphone and that detected by each of the corresponding sub microphones;

wherein the filter coefficient calculating unit is configured to obtain an acoustic system transfer function of sound pressure level on the basis of a sound pressure level detected by each main microphone, to obtain a sound pressure gradient by dividing a difference between the sound pressure level detected by the main microphone and that detected by each of the corresponding sub microphones by a distance between the main microphone and the sub microphone, to convert the sound pressure gradients into air particle velocities to obtain acoustic system transfer functions of air particle velocity, and to calculate the filter coefficient on the basis of the acoustic system transfer function of sound pressure level and the acoustic system transfer functions of air particle velocity.

2. The apparatus according to claim 1, wherein the sound field control apparatus comprises three sub microphones associated with each main microphone and wherein the filter coefficient calculating unit is configured to calculate the air particle velocities using the following expression:

$$v_{x1}(x, \omega) = \frac{1}{j\omega\rho_0}\frac{p(x_1, x_2, x_3, \omega) - p(x_1 + \Delta x_1, x_2, x_3, \omega)}{\Delta x_1}$$

$$v_{x2}(x, \omega) = \frac{1}{j\omega\rho_0}\frac{p(x_1, x_2, x_3, \omega) - p(x_1, x_2 + \Delta x_2, x_3, \omega)}{\Delta x_2}$$

$$v_{x3}(x, \omega) = \frac{1}{j\omega\rho_0}\frac{p(x_1, x_2, x_3, \omega) - p(x_1, x_2, x_3 + \Delta x_3, \omega)}{\Delta x_3}$$

where $v_{x1}$, $v_{x2}$, and $v_{x3}$ denote air particle velocities in the $x_1$-axis, $x_2$-axis, and $x_3$-axis directions, p denotes the sound pressure level, and $p_0$ denotes the density of air.

3. The apparatus according to claim 2, wherein the filter coefficient calculating unit is configured to calculate the filter coefficient using the following expression:

$$w(\omega)=[C(\omega)\, B_{x1}(\omega)\, B_{x2}(\omega)\, B_{x3}(\omega)]^{T+}\, h(\omega)$$

where w denotes the filter coefficient, C denotes the acoustic system transfer function of sound pressure level, $B_{x1}$, $B_{x2}$, and $B_{x3}$ denote the acoustic system transfer functions of air particle velocity in the $x_1$-axis, $x_2$-axis, and $x_3$-axis directions, and h denotes a target transfer function of air particle velocity.

4. The apparatus according to claim 2, wherein the filter coefficient calculating unit is configured to calculate the filter coefficient using the following expression:

$$w(\omega)=[\alpha_p C(\omega)\ \alpha_{vx1}B_{x1}(\omega)\ \alpha_{vx2}B_{x2}(\omega)\ \alpha_{vx3}B_{x3}(\omega)]^{T+}\ h(\omega)$$

where w denotes the filter coefficient, C denotes the acoustic system transfer function of sound pressure level, $B_{x1}$, $B_{x2}$, and $B_{x3}$ denote the acoustic system transfer functions of air particle velocity in the $x_1$-axis, $x_2$-axis, and $x_3$-axis directions, h denotes a target transfer function of air particle velocity, and $\alpha_p$, $\alpha_{vx1}$, $\alpha_{vx2}$, and $\alpha_{vx3}$ denote weighting factors.

5. The apparatus according to claim 2, wherein the filter coefficient calculating unit is configured to calculate the filter coefficient on the basis of an LMS algorithm with an adaptive filter using the following expression:

$$w(n+1,\omega)=w(n,\omega)+2\mu u^*(\omega)[C(\omega)\ B_{x1}(\omega)\ B_{x2}(\omega)\ B_{x3}(\omega)]^{T^H}\ E(\omega)$$

where w denotes the filter coefficient, C denotes the acoustic system transfer function of sound pressure level, $B_{x1}$, $B_{x2}$, and $B_{x3}$ denote the acoustic system transfer functions of air particle velocity in the $x_1$-axis, $x_2$-axis, and $x_3$-axis directions, μ denotes a step size parameter, n denotes the number of sequential computation updates by the adaptive filter, u* denotes the conjugate complex number of the input audio signal u, and E denotes an error.

6. The apparatus according to claim 2, wherein the filter coefficient calculating unit is configured to calculate the filter coefficient on the basis of an LMS algorithm with an adaptive filer using the following expression:

$$w(n+1,\omega)=w(n,\omega)+2\mu u^*(\omega)[\alpha_p C(\omega)\ \alpha_{vx1}B_{x1}(\omega)\ \alpha_{vx2}B_{x2}(\omega)\ \alpha_{vx3}B_{x3}(\omega)]^{T^H}\ E(\omega)$$

where w denotes the filter coefficient, C denotes the acoustic system transfer function of sound pressure level, $B_{x1}$, $B_{x2}$, and $B_{x3}$ denote the acoustic system transfer functions of air particle velocity in the $x_1$-axis, $x_2$-axis, and $x_3$-axis directions, μ denotes a step size parameter, n denotes the number of sequential computation updates by the adaptive filter, $u^*$ denotes the conjugate complex number of the input audio signal u, E denotes an error, and $\alpha_p$, $\alpha_{vx1}$, $\alpha_{vx2}$, and $\alpha_{vx3}$ denote weighting factors.

7. A computer-implemented method for controlling a sound field in an acoustic system including a filtering unit configured to filter an input audio signal and at least one speaker configured to output the audio signal filtered by the filtering unit, the method comprising:

calculating a filter coefficient used to control sound pressure levels and air particle velocities of the audio signal output from the at least one speaker in the space on the basis of a sound pressured level detected by each of at least two main microphones arranged at points of measurement in a space and a difference between the sound pressure level detected by a main microphone of the at least two main microphones and that detected by each set of sub microphones associated with the main microphone, each set of sub microphones comprising at least two sub microphones placed in different axis directions about each main microphone of the at least two main microphones, where each of the sub microphones is not a main microphone, setting the calculated filter coefficient in the filtering unit;

wherein calculating the filter coefficient comprises:

obtaining an acoustic system transfer function of sound pressure level on the basis of a sound pressure level detected by each main microphone, obtaining a sound pressure gradient by dividing a difference between the sound pressure level detected by the main microphone and that detected by each of the corresponding sub microphones by a distance between the main microphone and the sub microphone, converting the sound pressure gradients into air particle velocities to obtain acoustic system transfer functions of air particle velocity, and calculating the filter coefficient on the basis of the acoustic system transfer function of sound pressure level and the acoustic system transfer functions of air particle velocity.

* * * * *